US009481034B2

(12) United States Patent
Chen et al.

(10) Patent No.: US 9,481,034 B2
(45) Date of Patent: Nov. 1, 2016

(54) SURFACE TREATMENT FOR IMPROVED BONDING IN BI-METALLIC CASTING

(71) Applicant: GM Global Technology Operations LLC, Detroit, MI (US)

(72) Inventors: Yiqing Chen, Hefei (CN); Aihua A. Luo, Troy, MI (US); Anil K. Sachdev, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 105 days.

(21) Appl. No.: 14/099,474

(22) Filed: Dec. 6, 2013

(65) Prior Publication Data

US 2014/0290894 A1 Oct. 2, 2014

(30) Foreign Application Priority Data

Mar. 28, 2013 (CN) ..... 2013 1 0168848

(51) Int. Cl.
*B22D 19/00* (2006.01)
*B22D 19/16* (2006.01)

(52) U.S. Cl.
CPC ..... *B22D 19/0081* (2013.01); *B22D 19/16* (2013.01)

(58) Field of Classification Search
CPC ... B22D 19/00; B22D 19/0081; B22D 19/16
USPC ..... 164/75, 98, 100, 101, 102, 103
See application file for complete search history.

(56) References Cited

U.S. PATENT DOCUMENTS 4,643,241 A * 2/1987 Yonekura ..... B22D 19/00 164/101
5,259,437 A 11/1993 Jarry
5,293,923 A 3/1994 Alabi
6,474,397 B1 * 11/2002 Gunkel ..... B22D 19/04 164/100
8,714,231 B2 5/2014 Chiang et al.
8,746,322 B2 6/2014 Svoboda
8,852,359 B2 10/2014 Walker et al.

(Continued)

FOREIGN PATENT DOCUMENTS

CN 102529191 A 7/2012
CN 102794435 A 11/2012

(Continued)

OTHER PUBLICATIONS

First Office Action for related Chinese Application No. 201310168848.0 issued on Sep. 14, 2015 with letter from China Patent Agent (H.K.) Ltd.; 10 pages.

(Continued)

*Primary Examiner* — Kevin P Kerns
(74) *Attorney, Agent, or Firm* — Harness, Dickey & Pierce, P.L.C.

(57) ABSTRACT

Methods of forming bi-metallic castings are provided. In one method, a metal preform of a desired base shape is provided defining a substrate surface. A natural oxide layer is removed from the substrate surface, yielding a cleaned metal preform. The method includes forming a thin metallic film on at least a portion of the substrate surface of the cleaned metal preform, and metallurgically bonding the portion of the metal preform having the metallic film with an overcast metal to form a bi-metallic casting. The metallic film promotes a metallurgical bond between the metal preform and the overcast metal. In one aspect, the metal preform may include aluminum (Al) and the metallic film may include zinc (Zn).

20 Claims, 1 Drawing Sheet

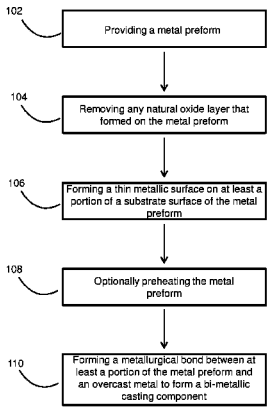

(56) References Cited

U.S. PATENT DOCUMENTS

| | | | |
|---|---|---|---|
| 8,889,226 | B2 | 11/2014 | Walker et al. |
| 2004/0187965 | A1 | 9/2004 | Nakao et al. |
| 2012/0086264 | A1 | 4/2012 | Carlson et al. |

FOREIGN PATENT DOCUMENTS

| | | | |
|---|---|---|---|
| CN | 102794436 | A | 11/2012 |
| CN | 102917816 | A | 2/2013 |
| CN | 102921926 | A | 2/2013 |
| EP | 0269006 | A2 | 6/1988 |

OTHER PUBLICATIONS

Second Office Action for related Chinese Application No. 201310168848.0 issued on May 9, 2016 with letter from China Patent Agent (H.K.) Ltd.; 11 pages.

* cited by examiner

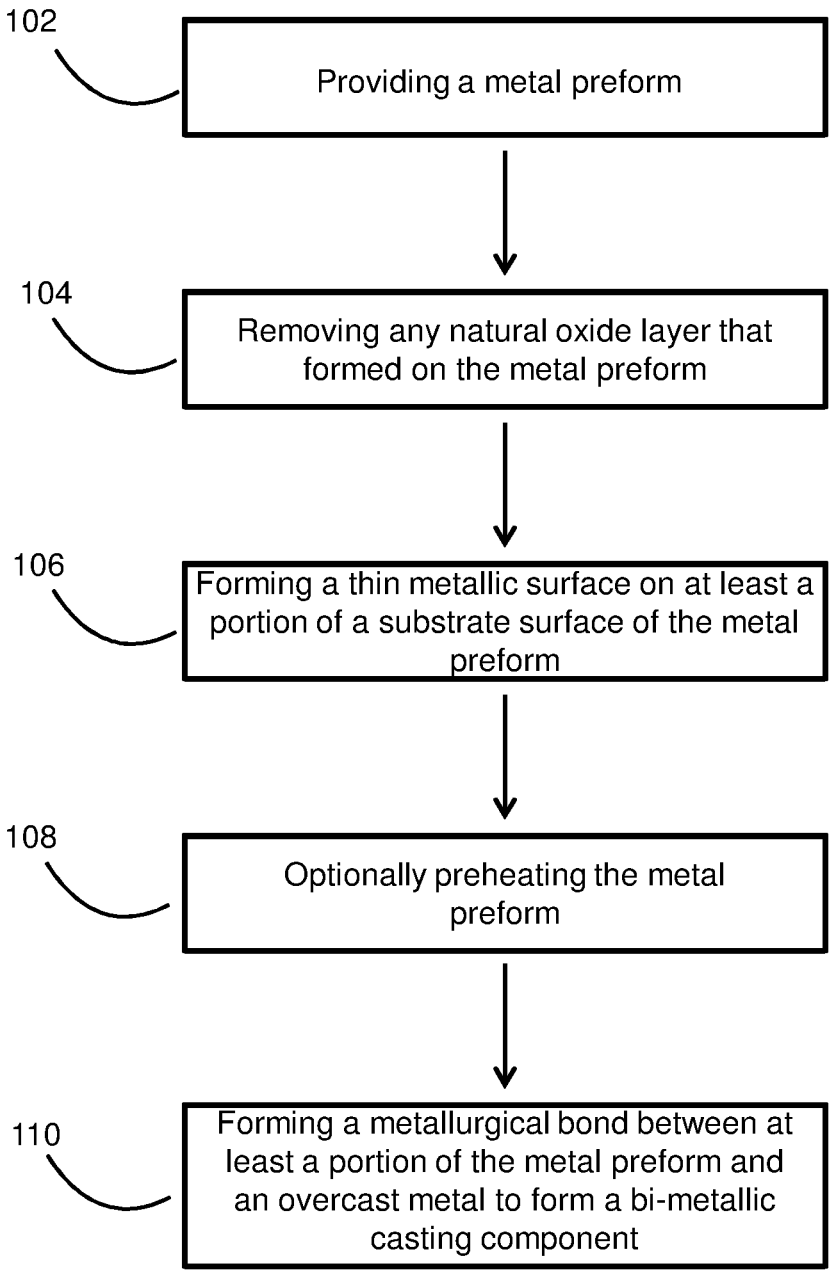
102
Providing a metal preform
104
Removing any natural oxide layer that formed on the metal preform
106
Forming a thin metallic surface on at least a portion of a substrate surface of the metal preform
108
Optionally preheating the metal preform
110
Forming a metallurgical bond between at least a portion of the metal preform and an overcast metal to form a bi-metallic casting component

SURFACE TREATMENT FOR IMPROVED BONDING IN BI-METALLIC CASTING

CROSS-REFERENCE TO RELATED APPLICATIONS

This application claims the benefit and priority of Chinese Patent Application No. 201310168848.0, filed Mar. 28, 2013. The entire disclosure of the above application is incorporated herein by reference.

FIELD

The present disclosure relates to methods of forming a bi-metallic casting and improving the metallurgical bonding between two metal components.

BACKGROUND

This section provides background information related to the present disclosure which is not necessarily prior art.

Bi-metallic casting techniques can be used to provide components having increased stiffness, strength, wear resistance, and other functionality. Bi-metallic casting allows two different metals to be combined in one component, while maintaining the distinct advantages offered by the constituent metals and/or alloys. In various bi-metallic casting techniques, at least a portion of base material or preform of a first metal or alloy is overcast with a second metal or ahoy. Metal preforms may have an oxide layer or oxide film on theft exterior substrate surface. Oxide layers may start as simple amorphous (non-crystalline) layers, such as $Al_2O_3$ on aluminum, MgO on magnesium and Mg—Al alloys, and $Cu_2O$ on copper. In certain aspects, their structures may derive from the amorphous melt on which they nucleate and/or grow and transform into complex and different phases and structures. The oxide layers may interfere with and/or negatively affect the ability of the metal preform to metallurgically bond with another metal under bonding conditions. Further, even if an oxide layer is once removed, there remains the possibility for another oxide layer to re-form under the appropriate oxidizing conditions and parameters. Thus, there remains a need for improved methods of forming even stronger metallurgical bonds between two metals joined using bi-metallic casting techniques.

SUMMARY

This section provides a general summary of the disclosure, and is not a comprehensive disclosure of its full scope or all of its features.

In various aspects, the present technology provides a method of forming a bi-metallic casting. In one method, a metal preform of a desired base shape is provided defining a substrate surface. A natural oxide layer is removed from the substrate surface, yielding a cleaned metal preform. The method includes forming a thin metallic film on at least a portion of the substrate surface of the cleaned metal preform, and metallurgically bonding the portion of the metal preform having the metallic film with an overcast metal to form a bi-metallic casting. The metallic film promotes a metallurgical bond between the metal preform and the overcast metal.

In other aspects, the present technology provides a method of forming a bi-metallic casting with improved bonding between metal components. The method comprises providing a metal preform of a desired base shape defining a substrate surface. A natural oxide layer is removed from the substrate surface and the substrate surface is etched. The method includes forming a thin metallic film on the substrate surface. The metallic film has a melting point lower than a melting point of the metal preform. The metal preform may be preheated and a metallurgical bond is formed between at least a portion of the metal preform and an overcast metal having a composition different from both the metal preform and the metallic film. The metallic film promotes the metallurgical bond between the metal preform and the overcast metal.

The present technology also provides a method of forming a bi-metallic casting with an aluminum preform. The method comprises removing a natural oxide layer from a surface of an aluminum preform and immersing the aluminum preform into a galvanizing bath. A thin metallic film is formed on the surface of the aluminum preform, having a thickness of less than about 250 μm. The aluminum preform may be preheated, and the method includes contacting at least a portion of the aluminum preform with a molten metal to form a bi-metallic casting. The metallic film substantially remains on the surface as an interface promoting a metallurgical bond between the aluminum preform and the molten metal.

Further areas of applicability will become apparent from the description provided herein. The description and specific examples in this summary are intended for purposes of illustration only and are not intended to limit the scope of the present disclosure.

DRAWINGS

The present teachings will become more fully understood from the detailed description and the accompanying drawing, wherein:

FIG. 1 is a flow diagram illustrating one method for forming a bi-metallic casting according to various aspects of the present teachings.

It should be noted that the drawing set forth herein is intended to exemplify the general characteristics of materials, methods, and devices among those of the present teachings, for the purpose of the description of certain aspects. The drawing may not precisely reflect all of the characteristics of any given aspect, and is not necessarily intended to define or limit specific embodiments within the scope of this technology.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology enhances methods of forming a bi-metallic casting by contemplating the removal of an oxide layer from a metal preform, and providing a thin metallic film thereon prior to forming a metallurgical bond between two metal components, such as a metal preform and an overcast metal.

With reference to FIG. 1, which generally represents steps of various embodiments of the methods used in the present technology, a metal preform is provided in step 102 and may have a desired base shape, size, and configuration for its intended end use. It is envisioned that the present technology may be used to manufacture numerous different kinds bi-metallic casting components, including non-limiting examples such as engine cradles, instrument panel beams, cast or wrought electric motors, gears, screws and screw barrels, housings, clamps, lugs, and the like. The metal preform may define a substrate surface. As used herein, the term "substrate surface" is generally representative of the outermost or exterior layer, or exposed area of the metal preform. Certain components may have more intricate shapes and features than other components. Accordingly, the size and shape of the metal preform will vary, as will the substrate surface thereof. While the material of the metal preform is not meant to be limited to certain metals, in various aspects, the metal preform may include one or more metal selected from the group including aluminum (Al), magnesium (Mg), iron (Fe), copper (Cu), and alloys and mixtures thereof. It should be understood that the preform may contain certain small amounts of impurities as is known in the art, or other metals in addition to the predominant metals or alloys present. By way of example, the metal preform itself may be a casting, a forging, an extrusion, a stamping, or a spun component. It may be provided as a solid component, or it may be shaped with apertures or gaps, having various thicknesses and cross-sectional areas. The metal preform may be machined or otherwise shaped as desired prior to additional processing.

With reference to step 104, the methods may include cleaning and/or pretreating the metal preform, and specifically removing any natural oxide layer that may have formed on the substrate surface(s) in order to yield a cleaned metal preform having a substrate surface substantially free from oxides. As used herein, the term "substantially free" is used to indicate that oxides are not intended to be included on the substrate surface, and that the substrate surface is either free from oxides, that a significant amount of oxides have been removed, and/or the remaining presence of oxides on the substrate surface is only a negligible amount.

As should be understood, various cleaning and degreasing treatments can be used with the present technology and their selection may be based on the condition of the metal preform, as well as the size, shape, and metal content. In certain aspects, the cleaning and oxide removal step 104 may include degreasing the substrate surface. Numerous degreasing techniques can be used as is known in the art. In one non-limiting example, the metal preform can be treated with a propanoyl ($C_3H_5O$) containing solution at about room temperature in an ultrasonic bath for about 5 minutes, or a time sufficient to meaningfully degrease the metal preform.

Once degreased, the metal preform can be subjected to an optional etching treatment. For example, the substrate surface can be treated with an alkali etching solution containing about 20 g/L NaOH and 5 g/L NaF. The treatment may take place at an elevated temperature of from about 60° to about 80° C., and the substrate surface may be exposed to the solution for a brief time of about 5-10 seconds, or more, as known in the art and based on the desired amount of etching. The metal preform may also be subjected to a metal pickling process to further remove impurities from the substrate surface. In one non-limiting example, the pickle liquor can include an acidic solution commensurate with a mixture about 750 ml of 50% $HNO_3$ and about 250 ml of 40% HF. Stronger or more diluted mixtures may also be used where desired. The pickling process may be performed at about room temperature for a brief time of about 5-10 seconds, or longer, as known in the art and based on the desired amount of treatment.

With reference to step 106, the method proceeds to the formation of a thin metallic film on at least a portion of the substrate surface of the metal preform, preferably a cleaned portion of the metal preform. In many instances, the thin metallic film can be formed over an entirety of the substrate surface. It is envisioned that the metallic film can provide numerous benefits to the bi-metallic casting process. In one aspect, the metallic film is provided over the metal preform having a thickness sufficient to prevent the formation or the re-formation of a natural oxide layer on the substrate surface prior to the subsequent casting and bonding processes. In various aspects, the metallic film is provided such that it has a melting point lower than a melting point of the metal preform. Exemplary, non-limiting examples of metals that can be used in the metallic film include zinc (Zn), tin (Sn), indium (In), bismuth (Bi), antimony (Sb), lead (Pb), rare earth (RE) metals, and mixtures thereof. In certain aspects, metal phosphides having low melting points may also be used, such as AlP, InP, $Ca_3P_2$, $Cu_3P$, and $Mg_3P_2$.

While not wishing to be bound by any particular theory, it is believed that the thin metallic film having a lower melting point (as compared to the metal preform) is able to improve wetting and thereby promote the metallurgical bonding of the metal preform to the overcast metal to form the bi-metallic casting. Yet, the metallic film is provided with a controlled thickness such that it does not provide enough metal for interfacial bonding in the bi-metallic casting. Thus, in various aspects, the thin metallic film layer may substantially remain on or at the substrate surface of the metal preform as a thin interface layer promoting the metallurgical bonding.

The metallic film may be formed on or applied to all or part of the substrate surface using known techniques in order to form the film or layer having a thickness of less than about 300 μm, preferably less than about 250 μm, less than about 200 μm, less than about 150 μm, and even less than about 100 μm or about 50 μm, in certain aspects.

By way of example, the formation of the metallic film where Zn is used may include incorporating at least one or both of a zincate immersion treatment and a zinc galvanizing treatment. Regarding the zincate immersion treatment, in one example, a bath may be prepared having a mixture commensurate with a solution containing about 360 g/L NaOH, 60 g/L ZnO, 15 g/L $KNaC_4H_4O_6.4H_2O$, and 1.5 g/L $FeCl_3.6H_2O$. The metal preform may be subjected to a first immersion in the bath for about 60 seconds at a temperature between about 18°-25° C., and a second immersion for about 30 seconds. It should be understood that other zincate immersion processes may also be used, and the parameters can be altered as desired in order to form a metallic layer having the appropriate controlled thickness as desired for the specific metals of the bi-metallic casting.

Additionally or alternatively, the metal preform may be subjected to a zinc galvanizing treatment. In one non-limiting example, a bath may be prepared having a mixture commensurate with a solution containing about 200 g/L KCl, 63 g/L $ZnCl_3$, 26 g/L $HBO_3$. The metal preform may be subjected to an immersion in the bath from about 15 to about 25 minutes at a temperature between about 18°-25° C., and with an applied electric current density of from about 0.5 to about 5 $A/dm^2$. Similar to the zincate immersion, it should be understood that other zinc galvanizing processes may also be used, and the parameters can be altered as desired in order to form a metallic layer having the appropriate thickness. It should also be understood that the processes and methods will be based, in part, on the specific metal(s) chosen for use in the formation of the metallic film.

After the metal preform is cleaned and the metallic film is formed, method step 108 of FIG. 1 represents an option of preheating step of the metal preform. The optional preheating step may serve to reduce the temperature gradient between the metal preform and the molten casting overcast metal, so as to reduce contraction stresses and/or shrinking in the casting. This may also minimize the potential for any defined bond lines at the casting interface. As is known, the temperature and the time of the preheating step can be varied in order to appropriately allow relaxation time.

With reference to method step 110, a metallurgical bond is formed between at least a portion or an entirety of the metal preform having the metallic film and an overcast metal to form a bi-metallic casting component. As discussed above, the metallic film may serve to promote the metallurgical bonding between the two metals and, in some aspects, may substantially remain on the substrate surface of the metal preform as an interface between the metals. In non-limiting examples, the overcast metal may include any metal, alloy, or combination thereof suitable for use in metal casting techniques, such as aluminum alloys and magnesium alloys. In various aspects, the selection of the specific overcast metal or alloy may be based on the final shape and configuration or end use of the bi-metallic casting component. The overcast metal may have a composition different from one or both of the metal preform and the metallic film. Where the bi-metallic casting component will have an intricate or complex final shape, a metal or alloy having a high degree of fluidity may be used. Where the bi-metallic casting component will be required to have increased strength, a different metal or alloy will be appropriately chosen.

The metallurgical bonding may be carried out by contacting the metal perform with a molten metal via a conventional molten metal casting process as known in the art, for example, using die casting or sand casting techniques. In this regard, the metal preform may be preheated prior to being placed in a suitable mold, or the mold may be equipped with heated die panels as is known in the art. Notably, molten metals, such as aluminum, react with air and instantaneously create oxides. Accordingly, care should be taken when contacting the metal preform with the molten material. Additional exemplary techniques for such bi-metallic casting can be found in U.S. Pat. No. 8,708,425 (issued on Apr. 29, 2014), the entire specification of which is incorporated herein by reference.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of forming a bi-metallic casting, the method comprising:

providing a metal preform of a desired base shape defining a substrate surface;

subsequently removing a natural oxide layer from the substrate surface by degreasing, yielding a cleaned metal preform;

subsequently forming a thin metallic film on at least a portion of the substrate surface of the cleaned metal preform via a zincate immersion treatment comprising subjecting the cleaned metal preform to a bath comprising NaOH, ZnO, $KNaC_4H_4O_6.4H_2O$, and $FeCl_3.6H_2O$ for about 60 seconds at a temperature of about 18° to about 25° C.; and subsequently metallurgically bonding the portion of the metal preform having the metallic film with an overcast metal to form a bi-metallic casting, wherein the metallic film promotes a metallurgical bond between the metal preform and the overcast metal.

2. The method of claim 1, further comprising preheating the metal preform prior to metallurgically bonding the metal preform with the overcast metal.

3. The method of claim 1, comprising providing the metallic film having a thickness sufficient to prevent reformation of the natural oxide layer, wherein the metallic film has a thickness of less than about 250 μm.

4. The method of claim 1, wherein the metallic film has a melting point lower than a melting point of the metal preform.

5. The method of claim 1, wherein removing the natural oxide layer from the substrate surface comprises:

treating the substrate surface with an alkali etching solution; and pickling the substrate surface after degreasing the substrate surface and before forming a thin metallic film on at least a portion of the substrate surface of the cleaned metal preform.

6. The method of claim 1, wherein forming the metallic film on at least a portion of the substrate surface of the cleaned metal preform further comprises incorporating a zinc galvanizing treatment.

7. The method of claim 1, wherein metallurgically bonding the portion of the metal preform having the metallic film with the overcast metal comprises a metal casting process using a molten metal.

8. The method of claim 1, wherein the metal preform comprises a metal selected from the group consisting of: aluminum (Al), magnesium (Mg), iron (Fe), copper (Cu), and alloys and mixtures thereof.

9. The method of claim 1, wherein the metallic film comprises a metal selected from the group consisting of zinc (Zn), tin (Sn), indium (In), bismuth (Bi), antimony (Sb), lead (Pb), rare earth (RE) metals, metal phosphides, and mixtures thereof.

10. The method of claim 1, wherein the overcast metal comprises one of an aluminum alloy, a magnesium alloy, or both.

11. The method of claim 1, wherein the metallic film is formed on an entirety of the substrate surface, and the overcast metal is metallurgically bonded to an entirety of the metal preform.

12. The method of claim 1, wherein the bath comprises about 360 g/L NaOH, 60 g/L ZnO, 15 g/L $KNaC_4H_4O_6.4H_2O$, and 1.5 g/L $FeCl_3.6H_2O$.

13. A method of forming a bi-metallic casting with improved bonding between metal components, the method comprising:

providing a metal preform of a desired base shape defining a substrate surface;

subsequently removing a natural oxide layer from the substrate surface;

subsequently etching the substrate surface;

subsequently forming a thin metallic film on the substrate surface, the metallic film having a melting point lower than a melting point of the metal preform;

subsequently preheating the metal preform; and subsequently forming a metallurgical bond between at least a portion of the metal preform and an overcast metal having a composition different from both the metal preform and the metallic film, wherein the metallic film promotes the metallurgical bond between the metal preform and the overcast metal.

14. The method of claim 13, wherein the metal preform comprises aluminum (Al) and the metallic film comprises zinc (Zn).

15. The method of claim 13, wherein the metallic film is formed having a thickness of less than about 250 μm.

16. The method of claim 13, wherein removing the natural oxide layer from the substrate surface comprises degreasing the substrate surface prior to etching the substrate surface.

17. The method of claim 16, wherein etching the substrate surface comprises treating the substrate surface with an alkali etching solution followed by pickling the substrate surface.

18. The method of claim 13, wherein forming the metallic film on the substrate surface comprises incorporating at least one or both of a zincate immersion treatment and a zinc galvanizing treatment.

19. The method of claim 13, wherein the metal preform is one of a casting, a forging, an extrusion, and a stamping, and forming the metallurgical bond between at least a portion of the metal preform and the overcast metal comprises a die casting or sand casting technique.

20. A method of forming a bi-metallic casting with an aluminum preform, the method comprising:

removing a natural oxide layer from a surface of an aluminum preform;

subsequently etching the surface of the aluminum preform;

subsequently immersing the aluminum preform into a galvanizing bath and forming a thin metallic film having a thickness of less than about 250 μm on the surface of the aluminum preform;

subsequently preheating the aluminum preform; and subsequently contacting at least a portion of the aluminum preform with a molten metal to form a bi-metallic casting, wherein the metallic film substantially remains on the surface of the aluminum preform as an interface promoting a metallurgical bond between the aluminum preform and the molten metal.

* * * * *